US010976144B1

(12) United States Patent
Peterson et al.

(10) Patent No.: US 10,976,144 B1
(45) Date of Patent: Apr. 13, 2021

(54) HIGH PRESSURE RIFLE CARTRIDGE WITH PRIMER

(71) Applicant: Vista Outdoor Operations LLC, Anoka, MN (US)

(72) Inventors: Bryan Peterson, Isanti, MN (US); Jared Kutney, Cambridge, MN (US); Joel L. Sandstrom, Corcoran, MN (US)

(73) Assignee: Vista Outdoor Operations LLC, Anoka, MN (US)

( * ) Notice: Subject to any disclaimer, the term of this patent is extended or adjusted under 35 U.S.C. 154(b) by 0 days.

(21) Appl. No.: 16/293,632

(22) Filed: Mar. 5, 2019

Related U.S. Application Data

(60) Provisional application No. 62/638,513, filed on Mar. 5, 2018.

(51) Int. Cl.
*F42C 19/00* (2006.01)
*F42C 19/08* (2006.01)

(52) U.S. Cl.
CPC ..... *F42C 19/083* (2013.01); *F42C 19/0807* (2013.01)

(58) Field of Classification Search
CPC .... F42C 19/083; F42C 19/0807; F42C 19/10; F42B 5/307; F42B 5/02; F42B 5/36; F42B 5/32
USPC ..... 102/470, 204, 430, 469
See application file for complete search history.

(56) References Cited

U.S. PATENT DOCUMENTS

| | | | |
|---|---|---|---|
| 39,109 | A | 7/1863 | Bakewell |
| 40,491 | A | 11/1863 | Mayall |
| 415,707 | A | 11/1889 | Emmens |
| 624,146 | A | 5/1899 | Young |
| 679,792 | A | 8/1901 | Stuart |
| 712,826 | A | 11/1902 | Mason |
| 1,353,118 | A | 9/1920 | Thompson |
| 1,473,355 | A | 11/1923 | Pillars et al. |
| 1,485,404 | A | 3/1924 | Martin et al. |
| 1,571,510 | A | 2/1926 | Dickerman |
| 2,068,516 | A | 1/1937 | Seavey |
| 2,381,900 | A | 8/1945 | Graumann et al. |
| 2,423,837 | A | 7/1947 | Martin |

(Continued)

FOREIGN PATENT DOCUMENTS

| | | |
|---|---|---|
| CA | 2399808 | 8/2001 |
| CH | 231293 A | 3/1944 |

(Continued)

OTHER PUBLICATIONS

Gleichman, et al. Cartridges, Caps, and Flints: A primer for Archaeologists, *Natural Cultural Services* (2005) 26 pages.

*Primary Examiner* — Michael D David
(74) *Attorney, Agent, or Firm* — Reed Smith LLP; Matthew P. Frederick; John M. Cogill

(57) ABSTRACT

A cartridge that generates higher than typical chamber pressures has an enhanced means of primer retention for retaining the primer in the primer recess of the casing. The means may be a lip folded onto a conical surface, a annular groove to receive deformed primer wall portion material upon detonation, a concavity in the rearward facing wall of the primer, a check valve in the flash tube to inhibit propellant gases from reaching the primer recess, or specifically configured primers with a greater length than diameter and with greater wall thicknesses.

18 Claims, 8 Drawing Sheets

(56) References Cited

U.S. PATENT DOCUMENTS

| | | | | |
|---|---|---|---|---|
| 2,441,897 | A | 5/1948 | Nichols | |
| 2,466,929 | A | 4/1949 | Catlin et al. | |
| 2,480,149 | A | 8/1949 | Liljegren | |
| 2,568,078 | A | 9/1951 | McGahey, Jr. | |
| 2,708,878 | A | 5/1955 | Eckstein | |
| 2,803,265 | A | 8/1957 | Coffey | |
| 2,868,128 | A | 1/1959 | Ramsey | |
| 2,915,972 | A | 12/1959 | Hitchens et al. | |
| 2,926,607 | A | 3/1960 | Muller, Jr. et al. | |
| 2,931,039 | A | 4/1960 | Henning et al. | |
| 2,948,219 | A | 8/1960 | Sapp | |
| 3,001,436 | A | 9/1961 | Deitemeyer | |
| 3,055,302 | A | 9/1962 | Bayard et al. | |
| 3,060,855 | A | 10/1962 | Henning et al. | |
| 3,099,958 | A | 8/1963 | Daubenspeck et al. | |
| 3,185,095 | A | 5/1965 | Mayer et al. | |
| 3,195,463 | A | 7/1965 | Foote et al. | |
| 3,312,168 | A | 4/1967 | Stadler et al. | |
| 3,351,019 | A | 11/1967 | Schaadt et al. | |
| 3,352,240 | A | 11/1967 | Eckstein | |
| 3,415,192 | A | 12/1968 | Stadler et al. | |
| 3,435,765 | A | 4/1969 | Gawlick | |
| 3,719,148 | A | 3/1973 | Gawlick et al. | |
| 3,771,453 | A | 11/1973 | Ciccone et al. | |
| 3,855,900 | A | 12/1974 | Barr et al. | |
| 4,014,264 | A | 3/1977 | Bendler et al. | |
| 4,029,015 | A | 6/1977 | Lachaussee et al. | |
| 4,083,307 | A | 4/1978 | Beermann et al. | |
| 4,179,992 | A | 12/1979 | Ramnarace et al. | |
| 4,361,093 | A | 11/1982 | Saxby | |
| 4,464,990 | A | 8/1984 | Bendler et al. | |
| 5,033,386 | A | 7/1991 | Vatsvog | |
| 5,151,555 | A | 9/1992 | Vatsvog | |
| 5,204,488 | A | 4/1993 | Cimolino et al. | |
| 5,259,288 | A | 11/1993 | Vatsvog | |
| 5,481,978 | A | 1/1996 | Müller et al. | |
| 6,090,178 | A | 7/2000 | Benini | |
| 6,095,051 | A | 8/2000 | Saxby | |
| 6,415,718 | B1 | 7/2002 | Saxby | |
| 6,516,725 | B2 | 2/2003 | Jackson et al. | |
| 6,564,719 | B2 | 5/2003 | Saxby | |
| 6,962,113 | B1 * | 11/2005 | Carlson | F42B 12/22 102/389 |
| 6,976,431 | B2 | 12/2005 | Westrom et al. | |
| 7,302,890 | B2 | 12/2007 | Saxby | |
| 7,458,322 | B2 | 12/2008 | Reynolds et al. | |
| 7,481,167 | B2 | 1/2009 | Engel et al. | |
| 7,690,310 | B2 | 4/2010 | Engel et al. | |
| 7,841,279 | B2 | 11/2010 | Reynolds et al. | |
| 8,365,669 | B1 | 2/2013 | Saxby | |
| 8,479,654 | B2 | 7/2013 | Rosales et al. | |
| 8,522,684 | B2 | 9/2013 | Davies et al. | |
| 8,524,018 | B2 | 9/2013 | Busky et al. | |
| 8,607,702 | B1 | 12/2013 | Donadio et al. | |
| 8,800,449 | B2 | 8/2014 | Schluckebier et al. | |
| 8,887,638 | B1 | 11/2014 | Calvert | |
| 8,978,559 | B2 | 3/2015 | Davies et al. | |
| 9,273,942 | B1 | 3/2016 | Burke et al. | |
| 9,989,343 | B2 | 6/2018 | Padgett et al. | |
| 1,004,804 | A1 | 8/2018 | Burrow | |
| 2003/0145754 | A1 | 8/2003 | Saxby | |
| 2007/0151473 | A1 | 7/2007 | Brunn | |
| 2007/0272111 | A1 | 11/2007 | Saxby | |
| 2010/0126740 | A1 * | 5/2010 | Hartmann | A62C 3/025 169/70 |
| 2010/0162912 | A1 * | 7/2010 | Kay | C01B 13/0229 102/202.14 |
| 2011/0214582 | A1 * | 9/2011 | Glasser | F42B 14/08 102/439 |
| 2011/0308417 | A1 * | 12/2011 | Glasser | F42B 14/061 102/374 |
| 2015/0020705 | A1 * | 1/2015 | Hartmann | A62C 3/025 102/369 |
| 2016/0018199 | A1 | 1/2016 | Nemec | |
| 2016/0238355 | A1 | 8/2016 | Dionne et al. | |
| 2016/0290774 | A1 * | 10/2016 | Langenbeck | F42B 5/025 |
| 2018/0209768 | A1 * | 7/2018 | Peterson | F42B 12/78 |

FOREIGN PATENT DOCUMENTS

| | | | |
|---|---|---|---|
| EP | 500462 | A1 | 8/1992 |
| EP | 1079199 | A2 | 2/2001 |
| EP | 1031006 | B1 | 11/2002 |
| ES | 2251074 | T3 | 4/2006 |
| ES | 2260939 | T3 | 11/2006 |
| FR | 2431111 | A1 | 2/1980 |
| GB | 440550 | A | 1/1936 |
| GB | 1591092 | | 6/1981 |
| GB | 2446600 | A | 8/2008 |
| RU | 2096730 | C1 | 11/1997 |
| RU | 2190181 | C2 | 9/2002 |
| RU | 2240487 | C2 | 11/2004 |
| SE | 519883 | C2 | 4/2003 |
| WO | WO2007119038 | A1 | 10/2007 |
| WO | WO2009025538 | A1 | 2/2009 |
| WO | WO2012081955 | A2 | 6/2012 |

* cited by examiner 107
44

108
30
109

108

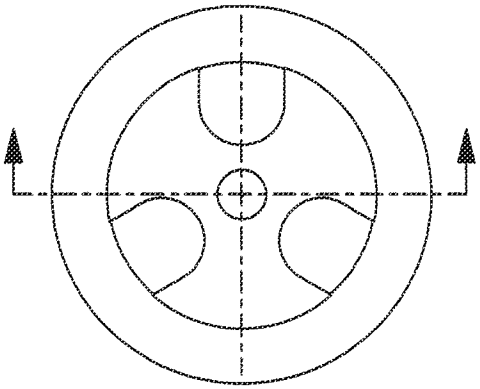
FIG. 14
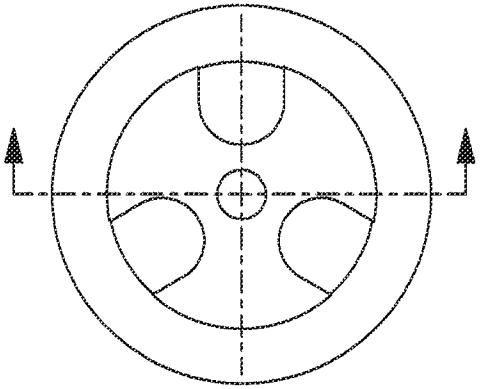
FIG. 16
FIG. 18
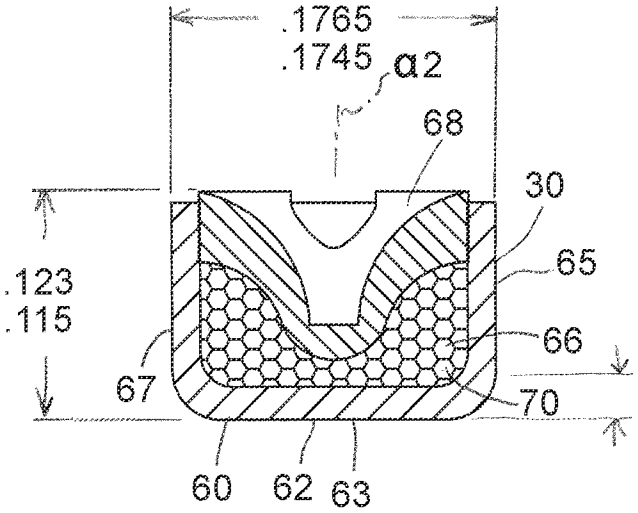
FIG. 15
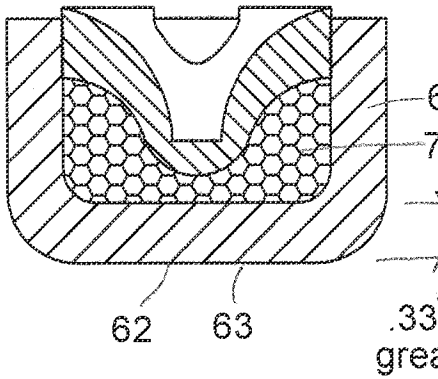
FIG. 17
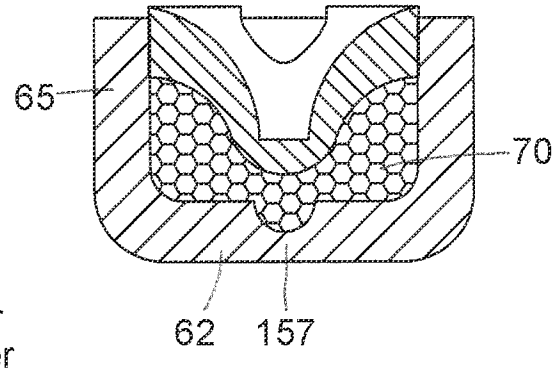
FIG. 19

HIGH PRESSURE RIFLE CARTRIDGE WITH PRIMER

CROSS-REFERENCE TO RELATED APPLICATION

This application claims the benefit of U.S. Provisional Application No. 62/638,513, filed Mar. 5, 2018, the entire contents of which are incorporated by reference herein.

BACKGROUND OF THE INVENTION

Conventional centerfire rifle cartridges develop maximum casing and barrel pressures of around 55,000 psi. In order to develop higher performance weaponry, higher firing pressures is an option for exploration. Such higher pressures are more demanding on equipment and ammunition.

SUMMARY OF THE INVENTION

The inventors have identified several failure modes, associated with rifle cartridges, and particularly associated with the primer, where the internal firing pressures are increased significantly above the conventional ranges. Such failures may include: rearward rupture of the primer allowing gas and debris to exit rearward of the cartridge in the chamber; dislocation of the primer from the cartridge casing; primer material lodging between the firing pin and bolt at the firing pin opening; primer flattening out.

In embodiments, the inventive aspects herein are for cartridges of 50 caliber and less.

A cartridge casing having a rearward head with a primer cavity, a primer disposed therein, a forward casing mouth leading into a propellant cavity, with propellant in the cavity, a projectile seated in the casing mouth. In embodiments, a cartridge casing utilizes specialized propellants for providing enhanced firing pressures of at least 75,000 psi. In embodiments, a cartridge casing utilizes specialized propellants and enhancements for providing enhanced firing pressures of at least 80,000 psi. In embodiments, a cartridge casing utilizes specialized propellants and structural enhancements for providing enhanced firing pressures at least 90,000 psi. In embodiments, a cartridge casing utilizes specialized propellants and enhanced structural features for providing enhanced firing pressures in embodiments at least 100.000 psi.

In embodiments, the cartridge casing has means for retention of the primer in the primer cavity during firing. Such means may include an annular rearwardly projecting ring that is crimped radially inward over a beveled or rounded rear corner surface of the primer. In embodiments, such means may include an annular inset groove extending radially outward in the inward facing cylindrical wall defining the primer cavity, whereby upon firing of the primer the primer housing material flows or deforms into the annular ring providing an axial lock to the primer.

In embodiments, the means for retention of the primer in the primer cavity includes a thickened housing wall of the primer providing enhanced strength of the primer, less deformation during firing and less likelihood of separation of the primer out of the primer cavity, the sensitivity of the primer is maintained by including a divot or hemispherical recess in one surface of the rearward wall thereby providing a thinned wall at the region immediately surrounding the impact point of the firing pin with the rearward face of the primer. The overall strength of the wall is not significantly diminished and the firing sensitivity is maintained.

In embodiments, the means for retention of the primer in the primer cavity includes a concave shape of the rearward facing wall of the primer such that when the firing pin engages the wall the wall surrounding the impact region of the firing pin is less likely to deform rearwarding around the firing pin and into the bolt opening from which the firing pin extends. Moreover the concave shape when forced rearwardly during detonation of the primer propellant, urges the concave shape towards a flat shape and as this happens the diameter of the concave wall portion increases providing an outward radial force on the rearward corner portion of the tubular axially extending housing forcing the corner portion into the inwardly facing surface of the casing that defines the primer cavity tending to lock the primer into the casing wall securing the primer in the cavity.

In embodiments, means for retaining the primer in the primer cavity of the casing may include means and/or structure to minimize the amount of pressure exerted on the forward face of the primer. One means or structure for this is a reduced diameter primer compared to conventional primers which are standardized to be 0.150 inches in diameter or larger. Reducing the diameter reduces the area upon which the firing pressure is distributed thus reducing the rearward force on the primer.

In embodiments, means for reducing the pressure exerted on the forward face of the primer is to provide a flash hole extending from the primer cavity to the propellant cavity wherein at the opening to the propellant cavity structure is provided to collapse or otherwise close the opening such that the firing pressure of the propellant is stopped by such closure. In embodiments a one way check valve is provided in or at the flash hole extending to the propellant chamber.

In embodiments, the casing may be manufactured of steel or brass. The primer housing and structure may be formed of steel or brass.

DESCRIPTION OF THE FIGURES

FIG. 14 is a top plan view of a primer.

FIG. 15 is a cross sectional view of the primer of FIG. 14.

FIG. 16 is a top plan view of a primer.

FIG. 17 is a cross sectional view of the primer of FIG. 16.

FIG. 18 is a top plan view of a primer.

FIG. 19 is a cross sectional view of the primer of FIG. 18.

Figure 2:
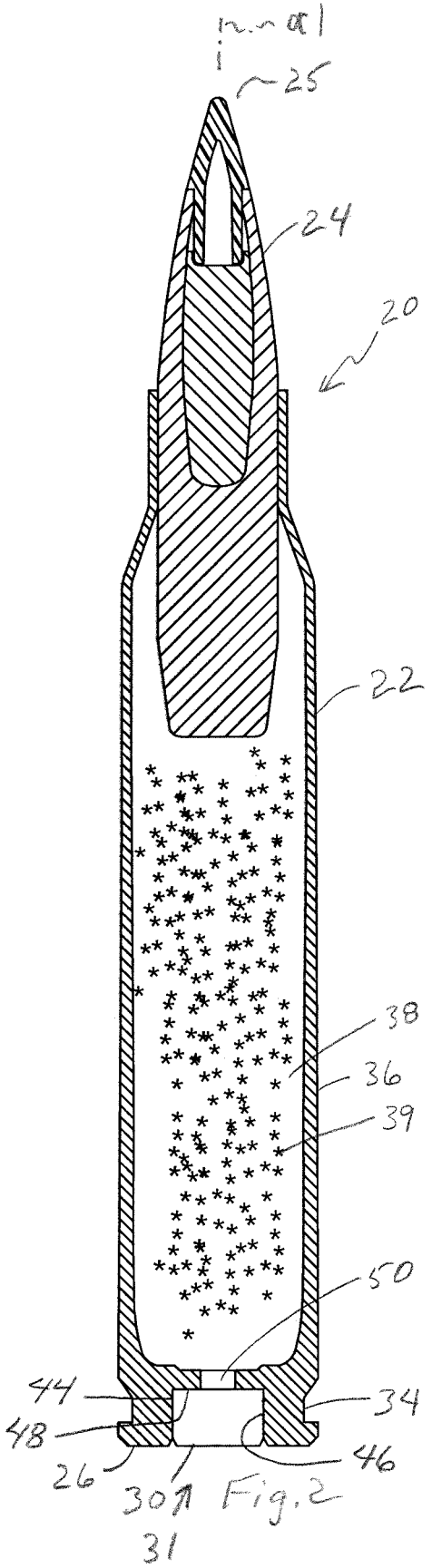
FIG. 2 is cross sectional view of the cartridge of FIG. 1.

While embodiments of the disclosure are amenable to various modifications and alternative forms, specifics thereof have been shown by way of example in the drawings and will be described in detail. It should be understood, however, that the intention is not to limit the disclosure to the particular embodiments described. On the contrary, the intention is to cover all modifications, equivalents, and alternatives falling within the spirit and scope of the disclosure.

DETAILED DESCRIPTION

Figure 1:
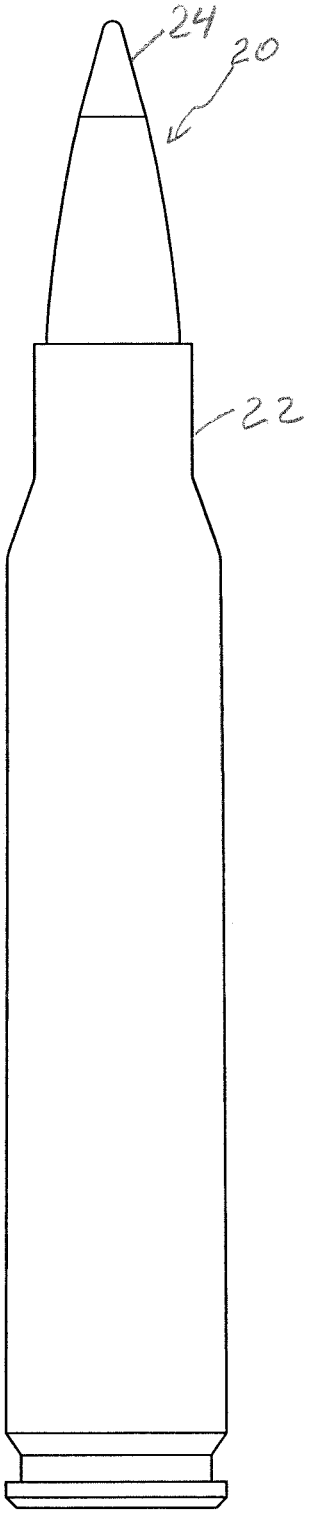
FIG. 1 is an elevation view of a cartridge in accord with embodiments.

Referring to FIGS. 1 and 2, a rifle cartridge 20 is illustrated a casing 22, a projectile 24, primer 30. The rifle cartridge has an axis α, a forward end 25 and a rearward end 26. In embodiments, the propellant, projectile are selected for generating higher than typical chamber pressures upon firing; for example, greater than 75,000 psi. The cartridges also include means 31 for retaining the primer in the casing under such higher than typical pressures as described in detail below. The casing 22 has a rearward head portion 34 and a unitary casing wall portion 36 extending forwardly and defining an interior 38 containing with propellant 39. The head portion having a primer recess 44 defined by a cylindrical wall surface 46 and a rearward facing stop surface 48. A flash hole 50 extends from the primer recess 44 to the interior and the propellant therein.

Referring to FIGS. 3A-5, and 15-18, primers are illustrated. Generally the primers 30 in these particular embodiments have a cup 60 with a circular wall portion 62 having a rearwardly facing surface 63, a skirt wall portion 65 unitary with the circular wall portion and defining a primer interior 66, and an axis α2. The primer cup circular wall portion having a cylindrical exterior wall surface 67 that is engaged with the cylindrical wall surface 46 of the head portion 34. An anvil 68 is positioned in the primer interior with primer compound 70 positioned between the cup and anvil and adhered to the inside surface 74 of the cup. A detonation zone 75 is defined between the rearward tip 78 of the anvil and the central portion 80 of the circular wall portion where the primer compound 70 is compressed upon striking of the center 81 of the circular wall portion 62 by a firing pin, not shown in these figures.

Figure 3B:
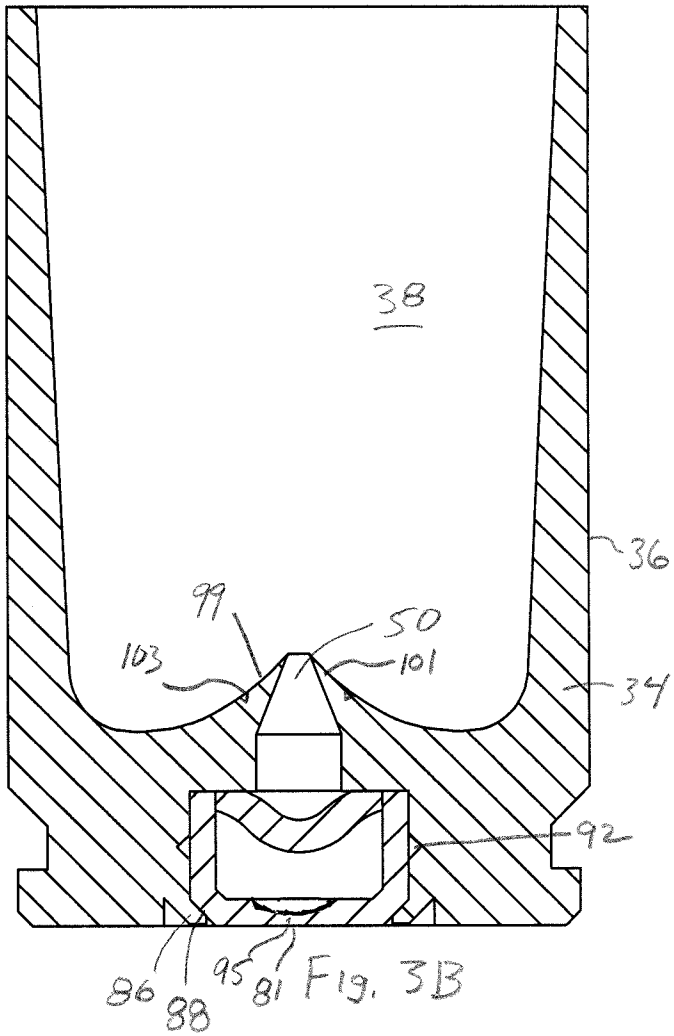
FIG. 3B is a cross sectional view of a casing and primer illustrating embodiments.
Figure 3A:
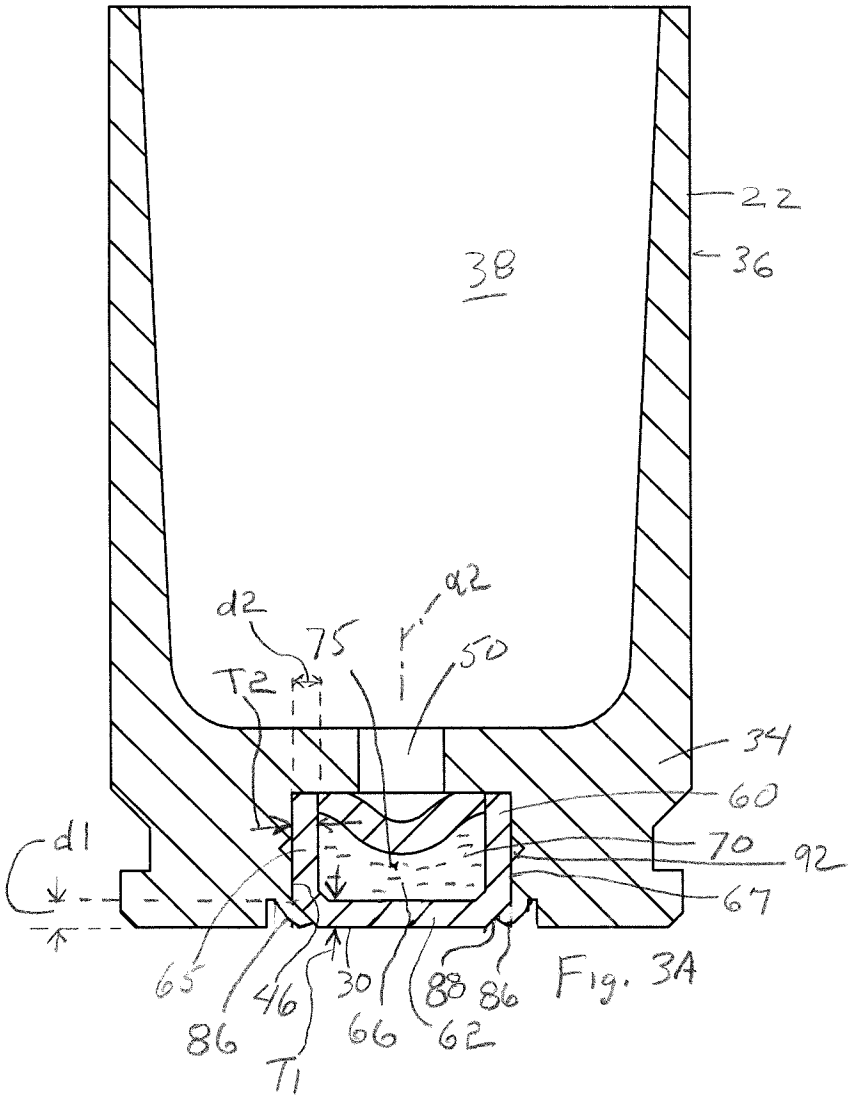
FIG. 3A is cross sectional view of a casing and primer illustrating embodiments.
Figure 6:
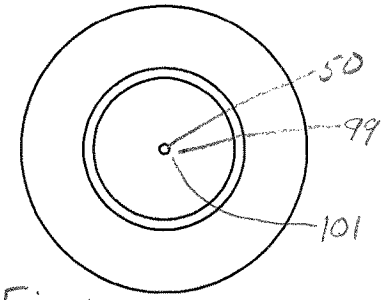
FIG. 6 is a forward end view of the casing of FIG. 5.
Figure 5:
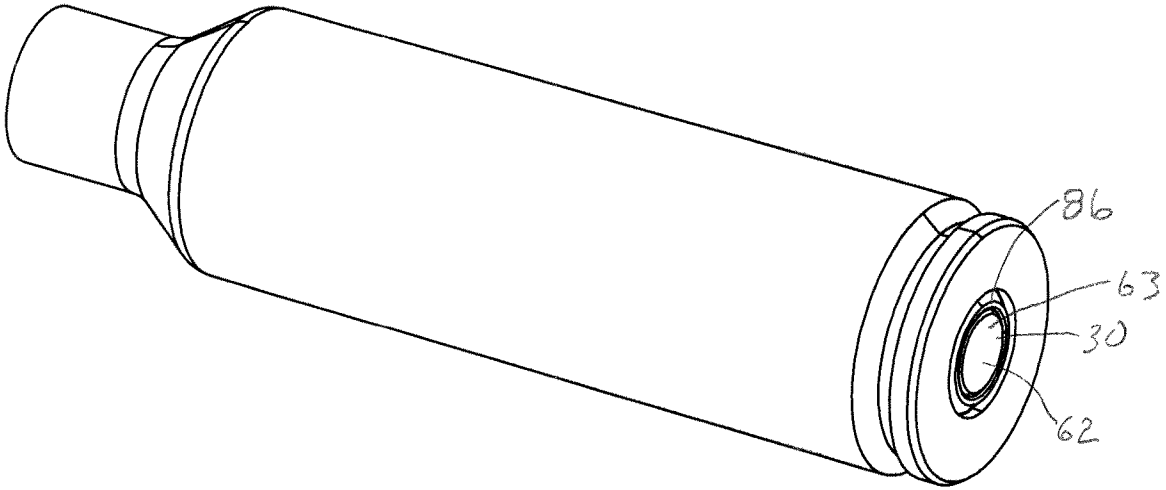
FIG. 5 is a perspective view of the casing of the cartridge of FIG. 4.

Referring to FIG. 3A, two distinct means for retention of a primers in the casing is depicted. First, a circular lip 86, also shown in FIGS. 5 and 6, is crimped over a chamfer 88 configured conical surface at the exterior corner of the circular wall portion and skirt wall portion. The conical surface, in embodiments, may extend an axial distance d1 that is about the thickness T1 of the circular wall portion. In embodiments the axial distance d1 is 80% of the thickness T1 of the circular wall portion. In embodiments, the radial distance d2 of the chamfer is about the thickness T2 of the skirt wall portion 65. In embodiments the axial distance d2 is 80% of the thickness T2 of the circular wall portion. In embodiments, the lip 86 mostly covers the conical surface 88. Secondly, an annual recess 92 in the cylindrical all surface 46 defining the primer recess received deformed cup material upon detonation of the primer compound 70, discussed in more detail below with reference to FIGS. 24 and 25.

Figure 25:
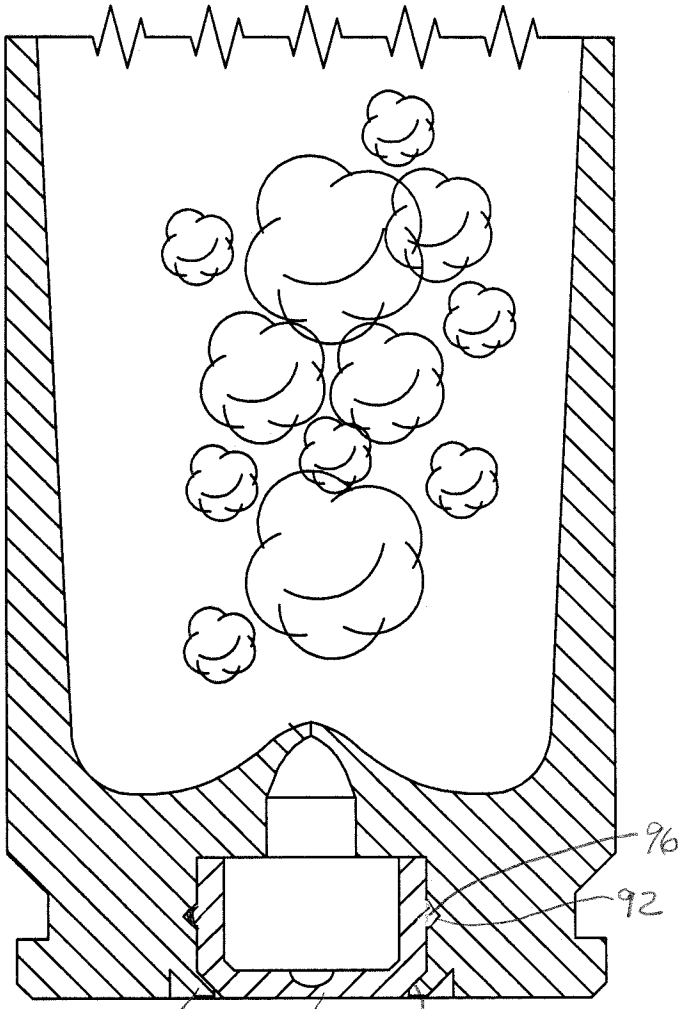
FIG. 25 is the cartridge of FIG. 24 after detonation of the primer compound and propellant.
Figure 24:
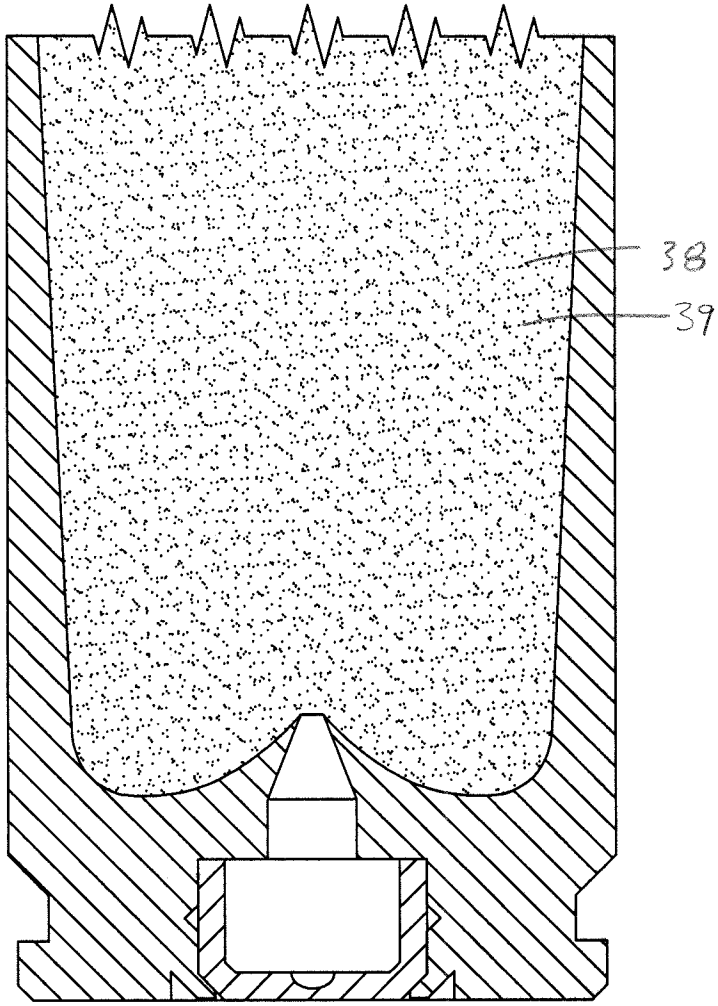
FIG. 24 is a cross sectional view of a cartridge in accord with embodiments.

Referring to FIGS. 3B, 24, and 25, the circular wall portion may have a centrally positioned thinning at a thinned wall portion 95. This may provide for easier deformation of the circular wall portion by the firing pin for detonating the primer compound, particularly when thicker primer wall portions than typical are utilized. The lips 86 are crimped or staked over the conical surface 88 of the primer and an annular recess 92 may received deformed primer wall portion material. Additionally, in the embodiment of FIG. 3B, the flash hole 50 is defined by a tapering nozzle 99 formed from the head portion 34 of the casing. See also FIG. 6. The flash tube wall portions 101 may be configured to collapse under pressure when the propellant in the casing interior 38 ignites. Additional structure such as fold grooves 103 may be added to facilitate the inward folding of the wall portions 101. The flash hole structure effectively operates as a check valve. Other structure accomplishing the check valve effect may also be utilized.

Figures 7, 8, 9, 10, 11, 12, 13:
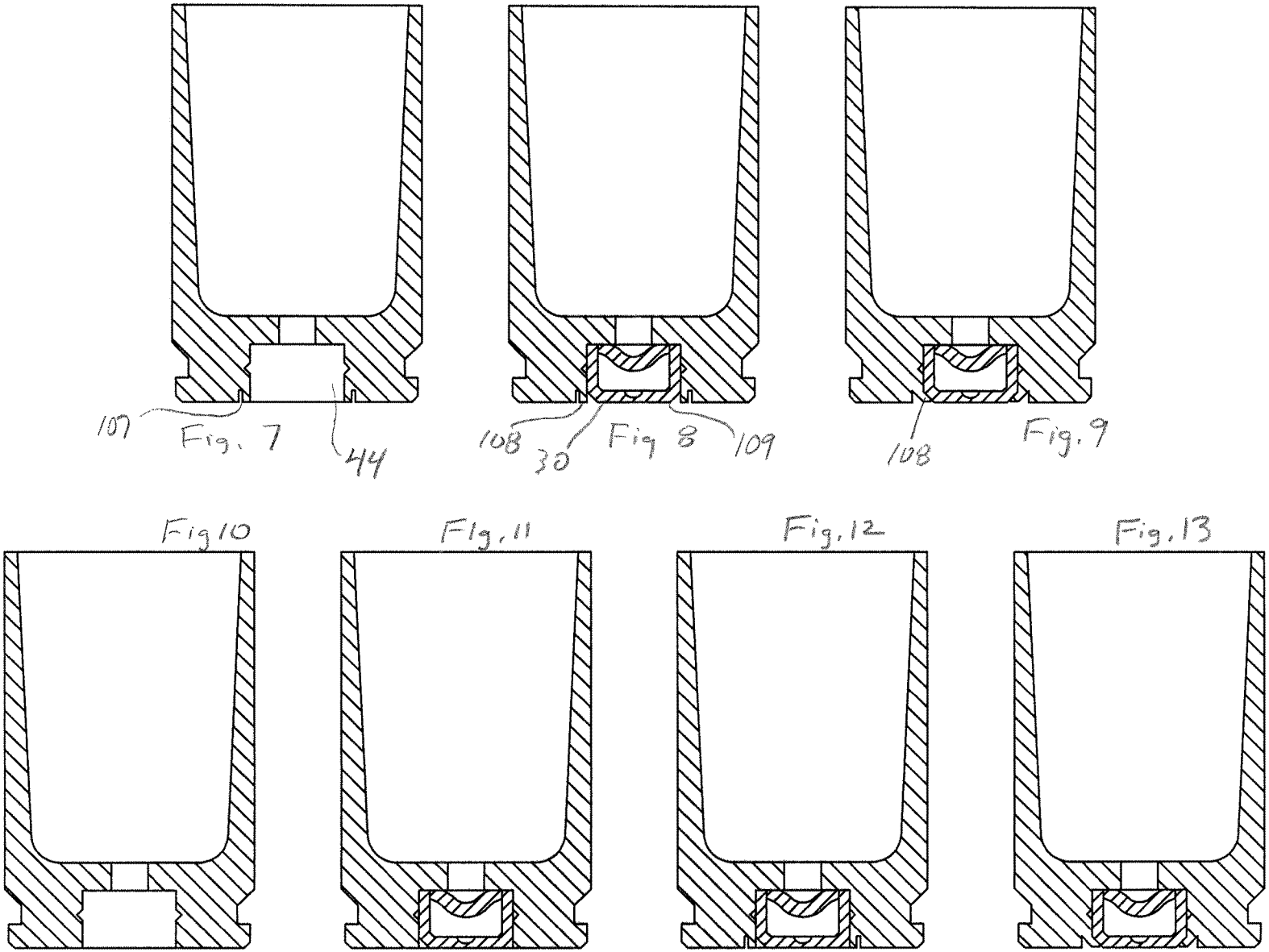
FIGS. 7-9 illustrate a sequence of securing a primer to a casing in accord with embodiments.
FIGS. 10-13 illustrate a sequence of securing a primer to a casing in accord with embodiments.

Referring to FIGS. 7-9, steps in securing a primer 30 in a primer recess 44 accord with embodiments are depicted. The head portion 34 has a annular groove 107 formed before insertion of the primer. The primer is inserted and the lip 108 defined by the groove is crimped over onto the corner 109 of the primer. The corner may have a conical surface.

Referring to FIG. 10-13, the groove may be stamped into the face of the head portion after insertion of the primer. The groove may be in one step and the crimping over in another step. In embodiments, a single step may form the groove and fold the lip over the corner of the primer, that is, leaving out the step illustrated in FIG. 12.

Figure 23:
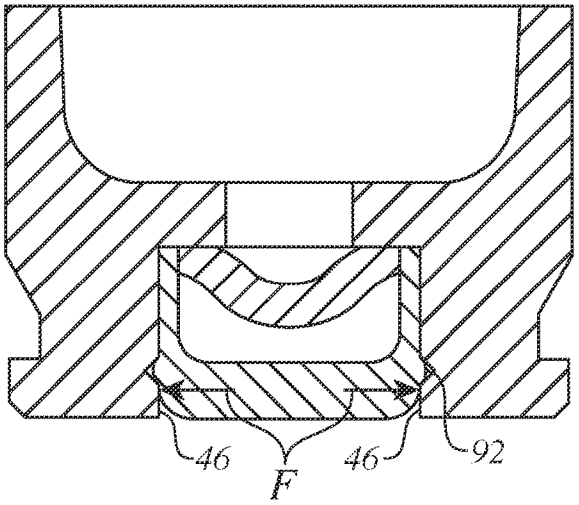
FIG. 23 is a view of the primer of FIG. 22 after detonation of the primer compound in the primer.
Figure 21:
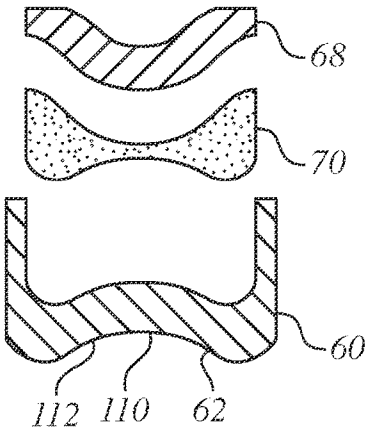
FIG. 21 is an exploded view of the primer of FIG. 20.
Figure 22:
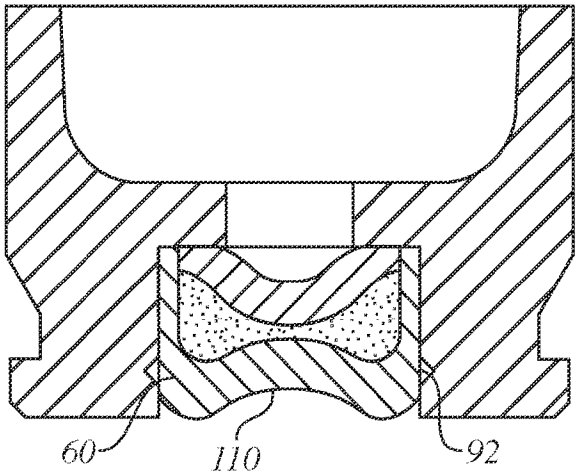
FIG. 22 is a view of the primer of FIG. 20 in a casing.
Figure 20:
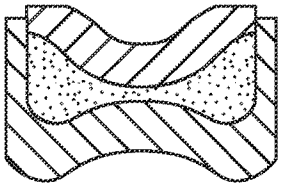
FIG. 20 is a cross sectional view of a primer in accord with an embodiment.

Referring to FIGS. 20-23, and additional means for retaining a primer in a casing is illustrated. The circular wall portion may have a concave portion 110 with a concavity 112. The concavity as shown in FIG. 22 may, upon detonation, expand outwardly, losing the concavity as shown in FIG. 23. The effect of the concave portion becoming essentially planar as shown in FIG. 23 is to effect an outward radial force F against the wall surface 46 defining the primer recess 44 which can facilitate the skirt portion deformation into the recess 92 and otherwise clamp the primer into the recess.

Figure 26:
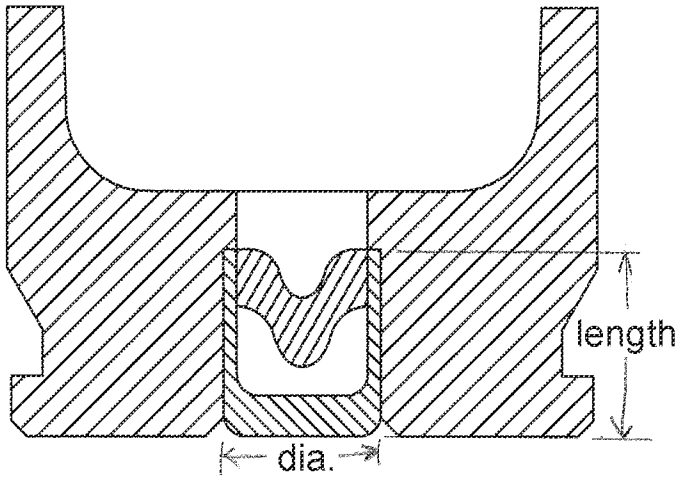
FIG. 26 is a cross sectional view of a primer in a recess, the primer having a aspect ratio of diameter to length of less than 0.8.

Referring to FIG. 26, a primer with a aspect ratio of diameter to length of less than 1.0 in embodiments is illustrated. In embodiments the aspect ratio may be less than 0.8. Such a primer provides less surface area in communication with the propellant gases and therefore less ejection force from the primer recess. Moreover, the reduced size provides a more robust package for handling higher than typical chamber pressures. A conventional primer may have a diameter of 0.1745 to 1765 inches, and a length of 0.115 to 0.123 inches, see FIG. 15. An embodiment with an aspect ratio of 1.0 or less may have a reduced diameter of 0.160 or less in embodiments and a like size length or a greater length. Embodiments may have a diameter of 1.50 or less and a like size length or a greater length.

Figure 27:
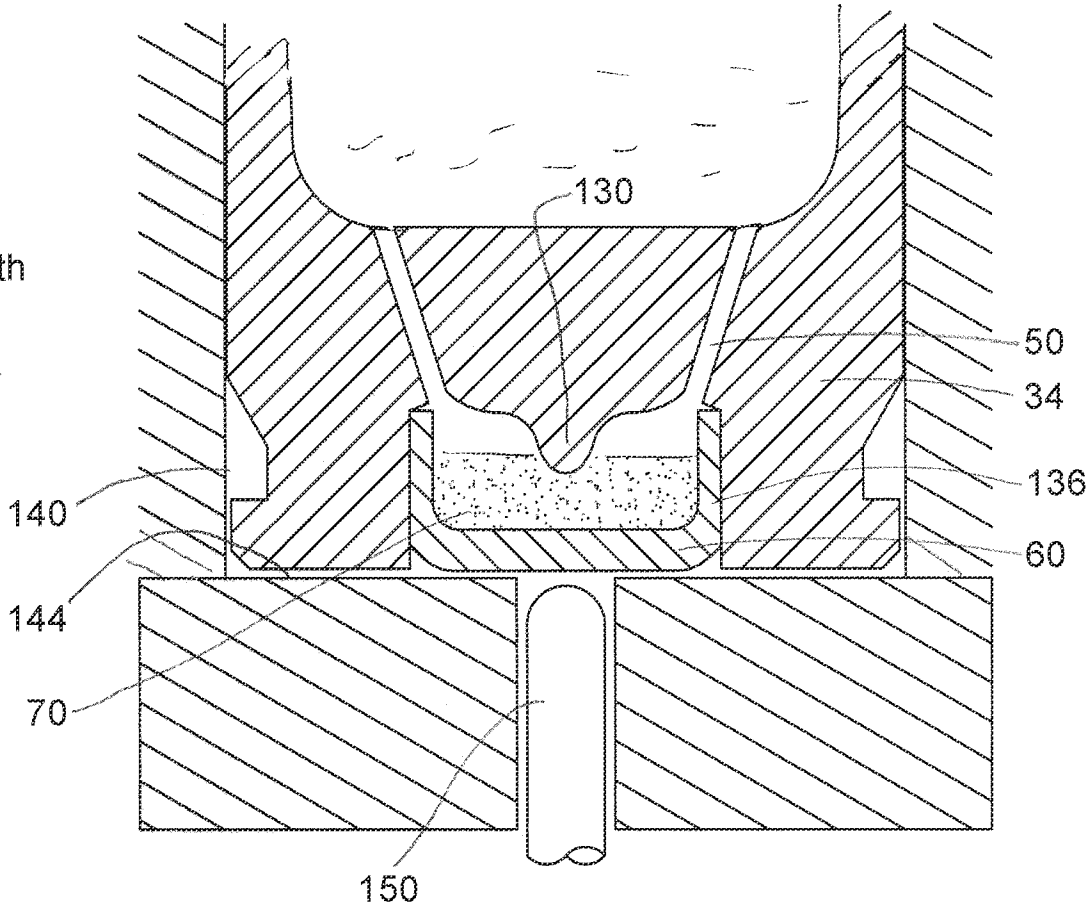
FIG. 27 is a cross sectional view of a Berdan primer in accord with embodiments.

Referring to FIG. 27, a Berdan primer 136 with the anvil portion 130 being unitary with the head portion 34 and two or more flash holes 50. The cartridge 20 is seated in a firearm chamber 140 with a bolt face 144 in the in-battery position and a firing pin 150 ready to strike the primer. Embodiments described herein may also be suitable for use with the Berdan primer.

FIGS. 17 and 18 illustrate primers with thicker than typical cup wall thickness, particularly compared to a primer with typical wall thicknesses shown in FIG. 15. The skirt wall portions 65 may be substantially the same thickness as the circular wall portion 62. The thicknesses, may be in embodiments greater than 0.030 inches. In embodiments, greater than 0.035 inches. A thinned portion 157 of the circular wall portion may facilitate the detonation of the propellant compound.

These examples illustrate that different structures, each having a primer retention function, can be combined in different combinations as may be appropriate. on the primer n A and 3B, and. FIG. 2 illustrates a cross section of the casing 20 with a primer 30 therein illustrating several aspects that may be included in combination or individually. The primer received in a primer recess 36, the recess may have an annular projection 40 that is crimped inwardly on the primer beveled shoulders 42. The rearward wall 46 may have a divot 48 on the inside surface 50 of said wall. An annular groove 52 may allow deformation of the outer wall of the primer to enter the groove to lock the primer into the primer cavity.

Continuing to refer to FIG. 2, a flash hole 54 from the primer 30 to the propellant chamber 58 may have structure 60 that closes off the flash hole upon ignition of the propellant in the propellant chamber.

Figure 4:
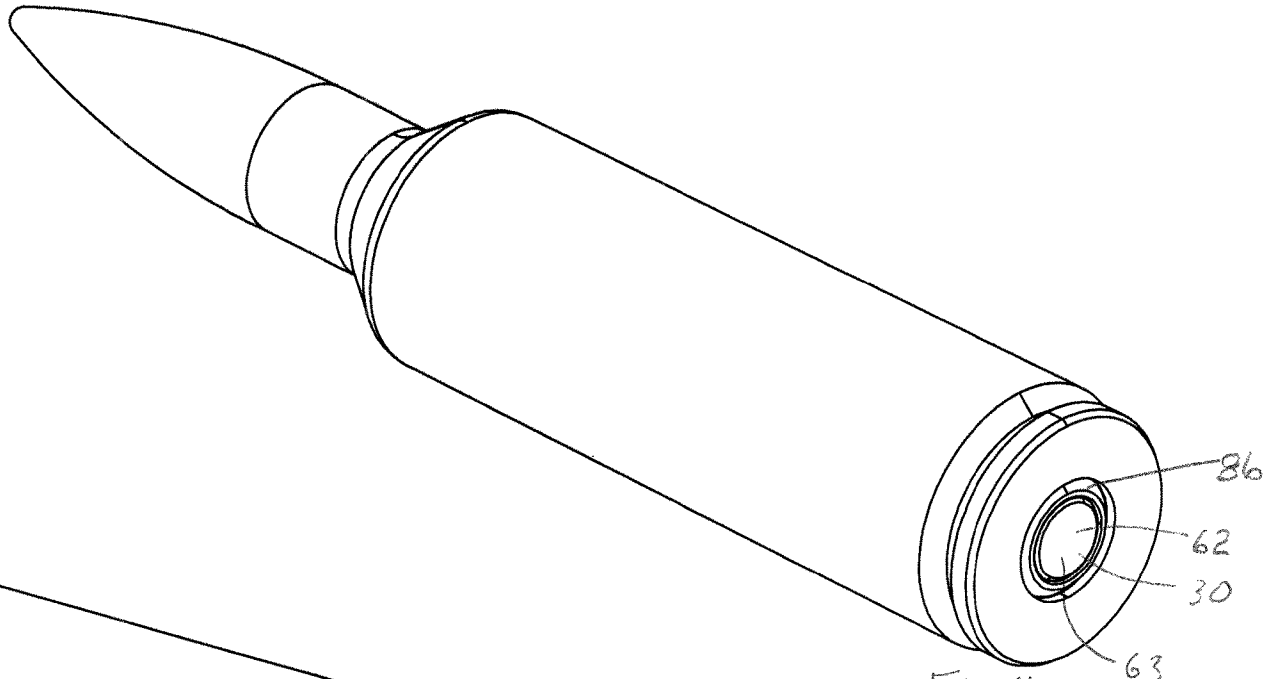
FIG. 4 is a perspective view of a cartridge in accord with embodiments.

Referring to FIGS. 3-5, in an embodiment, the primer may have a elongate axially configuration where the diameter d is less that the traditional minimal dimension of rifle primers. In embodiments, the diameter to length 1 is less than conventional rifle primers.

Referring to FIGS. 6-8, a primer has a concave rear wall portion 70 that may deform upon firing to radially expand the rearward wall effectively clamping the primer into the cavity.

The following United States patents are hereby incorporated by reference herein in their entirety: U.S. Pat. Nos. 1,485,404, 2,068,516, 2,423,837, 2,868,128, 2,926,607, 3,195,463, 3,312,168, 3,351,019, 3,352,240, 3,415,192, 3,719,148, 4,029,015, 4,083,307, 5,481,978, 6,516,725, 7,458,322, 9,989,343, and U.S. Ser. No. 10/048,049. The above references in all sections of this application are herein incorporated by references in their entirety for all purposes. Components illustrated in such patents may be utilized with embodiments herein. Incorporation by reference is discussed, for example, in MPEP section 2163.07(B).

"Substantially" when referring to a quality means mostly, unless otherwise defined, when referring to a quantified parameter, unless otherwise defined, means within 10% of that quantified parameter.

All of the features disclosed in this specification (including the references incorporated by reference, including any accompanying claims, abstract and drawings), and/or all of the steps of any method or process so disclosed, may be combined in any combination, except combinations where at least some of such features and/or steps are mutually exclusive.

Each feature disclosed in this specification (including references incorporated by reference, any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any incorporated by reference references, any accompanying claims, abstract and drawings), or to any novel one, or any novel combination, of the steps of any method or process so disclosed The above references in all sections of this application are herein incorporated by references in their entirety for all purposes.

Although specific examples have been illustrated and described herein, it will be appreciated by those of ordinary skill in the art that any arrangement calculated to achieve the same purpose could be substituted for the specific examples shown. This application is intended to cover adaptations or variations of the present subject matter. Therefore, it is intended that the invention be defined by the attached claims and their legal equivalents, as well as the following illustrative aspects. The above described aspects embodiments of the invention are merely descriptive of its principles and are not to be considered limiting. Further modifications of the invention herein disclosed will occur to those skilled in the respective arts and all such modifications are deemed to be within the scope of the invention.

What is claimed is:

1. A cartridge comprising:

a cartridge casing formed of a rearward head portion and a casing wall portion extending forwardly from the rearward head portion and defining an interior, the rearward head portion having a rearward head portion wall with a rearward primer recess and a flash hole extending to the interior, the casing wall portion defining an open forward mouth, a bullet seated in the open forward mouth;

propellant disposed in the interior and rearward of the bullet; and a primer seated in the rearward primer recess, the primer having a cup portion with a base portion configured as a rearward circular wall portion, a forward extending skirt wall portion unitary with the rearward circular wall portion and defining a primer interior, primer compound disposed in the primer interior, an anvil seated on the primer interior sandwiching the explosive material between the anvil and the circular wall portion;

a means for retaining the primer with chamber pressures upon firing of 75,000 to 100,000 psi, the means comprising the primer having an aspect ratio of diameter to axial length, and wherein the aspect ratio is less 1, and the means further comprising the primer skirt wall having a thickness of 0.026 to 0.030 inches and wherein the circular wall portion has a central thinned wall portion allowing for easier deformation by a firing pin, the means further comprising staking of the rearward head portion wall over the primer.

2. The cartridge of claim 1, wherein the means for retaining the primer comprises the primer with a chamfer on the cup portion, the chamfer configured as a conical surface between a cylindrical wall of the skirt portion and the rearward circular wall portion and wherein the rearward head portion wall is staked around and engages the conical surface.

3. The cartridge of claim 1, wherein the means for retaining the primer further comprises a check valve structure defining the flash hole.

4. The cartridge of claim 1, wherein the means for retaining the primer further comprises a flash hole structure that closes upon detonation of the propellant.

5. The cartridge of claim 1, wherein the central thinned wall portion has a thickness that is at least 40% thinner than the wall thickness of the circular wall portion surrounding the central thinned wall portion.

6. The cartridge of claim 1, wherein the means for retaining the primer comprises an annular groove in a cylindrical wall surface of the rearward head portion defining the rearward primer recess, opening, wherein the rearward primer recess has a depth and the annular groove has an annular center that is positioned a distance from a rearward face of the head portion that is less than 40% of the depth of the rearward primer recess, wherein upon detonation of the primer compound, the wall skirt is deformed into the annular groove.

7. The cartridge of claim 6 wherein the primer has a cylindrical wall surface with an axial length and the annular groove is positioned at the midpoint of the axial length of the cylindrical wall surface.

8. The cartridge of claim 1, wherein the means for retaining the primer comprises the rearward circular wall portion having a central concavity before detonation of the primer compound, and wherein detonation of the primer compound the rearward central wall portion loses or mostly loses the concavity resulting in a radially outward force around a periphery of the rearward central wall portion.

9. The cartridge of claim 1 wherein the cylindrical surface defining the primer recess has an annular recess and upon detonation the skirt wall portion deforms into the annular recess and wherein the annular recess is proximate a juncture of the circular wall portion and the skirt wall portion.

10. The cartridge of claim 1, wherein the casing comprises steel.

11. A cartridge comprising:

a cartridge casing formed of a rearward head portion and a casing wall portion extending forwardly from the rearward head portion and defining an interior, the rearward head portion having a rearward primer recess and one or more flash holes extending to the interior, the casing wall portion defining an open forward mouth, a bullet seated in the open forward mouth;

propellant disposed in the interior and rearward of the bullet; and a primer seated in the rearward primer recess, the primer having a cup portion with a base portion configured as a rearward circular wall portion, a forward extending skirt wall portion unitary with the rearward circular wall portion and defining a primer interior, the cup portion formed of steel, primer compound disposed in the primer interior, wherein the primer has an aspect ratio of diameter to axial length, and wherein the aspect ratio is less 0.80; and means for retaining the primer with chamber pressures upon firing of 75,000 to 100,000 psi.

12. The cartridge of claim 11, wherein the means for retaining the primer comprises the primer with a chamfer on the cup portion, the chamfer configured as a conical surface between a cylindrical wall of the skirt portion and the rearward circular wall portion and wherein the rearward cylindrical wall is staked around and engages the conical surface.

13. The cartridge of claim 12 wherein the conical surface extends an axial distance equal to at least 80% of the wall thickness of the rearward circular wall portion.

14. The cartridge of claim 12, wherein the means for retaining the primer comprises a circular lip extending over a corner of the primer extending entirely around the primer and extending radially inward a distance equal to at least 50% of a wall thickness of the skirt wall portion.

15. The cartridge of claim 11, wherein the means for retaining the primer further comprises a flash hole structure that closes upon detonation of the propellant.

16. A cartridge comprising:

a cartridge casing formed of a rearward head portion and a casing wall portion extending forwardly from the rearward head portion and defining an interior, the rearward head portion having a rearward primer recess and flash hole structure providing one or more flash holes extending to the interior, the casing wall portion defining an open forward mouth, a bullet seated in the open forward mouth;

propellant disposed in the interior, and rearward of the bullet; and a primer seated in the rearward primer recess, the primer having a cup portion with a base portion configured as a rearward circular wall portion, a forward extending skirt wall portion unitary with the rearward circular wall portion and defining a primer interior, primer compound disposed in the primer interior, wherein the primer has an aspect ratio of diameter to axial length, and wherein the aspect ratio is less 0.80; wherein the flash hole structure closes upon detonation of the propellant, and wherein the casing is staked around the primer; wherein the primer is retained in the cartridge casing with chamber pressures upon firing of 75,000 to 100,000 psi.

17. The cartridge of claim 16, wherein the rearward circular wall portion having a central concavity before detonation of the primer compound, and wherein detonation of the primer compound the rearward central wall portion loses or mostly loses the concavity resulting in a radially outward force around a periphery of the rearward central wall portion.

18. The cartridge of claim 16, wherein the diameter of the primer is 0.1765 inches or less.

* * * * *